US009822946B2

(12) United States Patent
Yamamoto

(10) Patent No.: US 9,822,946 B2
(45) Date of Patent: Nov. 21, 2017

(54) ILLUMINATION DEVICE

(75) Inventor: Shoji Yamamoto, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 82 days.

(21) Appl. No.: 14/233,224

(22) PCT Filed: Jul. 17, 2012

(86) PCT No.: PCT/JP2012/068134
§ 371 (c)(1),
(2), (4) Date: Jan. 24, 2014

(87) PCT Pub. No.: WO2013/011987
PCT Pub. Date: Jan. 24, 2013

(65) Prior Publication Data

US 2014/0254174 A1 Sep. 11, 2014

(30) Foreign Application Priority Data

Jul. 20, 2011 (JP) ..... 2011-159266

(51) Int. Cl.

| | |
|---|---|
| ***F21V 3/00*** | (2015.01) |
| ***F21V 17/14*** | (2006.01) |
| ***F21V 3/04*** | (2006.01) |
| ***F21V 3/02*** | (2006.01) |
| *F21K 9/23* | (2016.01) |
| *F21Y 115/10* | (2016.01) |

(52) U.S. Cl.
CPC ..... *F21V 3/00* (2013.01); *F21V 3/02* (2013.01); *F21V 3/0436* (2013.01); *F21V 17/14* (2013.01); *F21K 9/23* (2016.08); *F21Y 2115/10* (2016.08)

(58) Field of Classification Search
CPC . F21V 3/00; F21V 3/02; F21V 3/0436; F21V 17/14; F21V 17/104; F21Y 2101/02; F21K 9/1355
USPC ..... 362/311.14
See application file for complete search history.

(56) References Cited

U.S. PATENT DOCUMENTS 3,524,981 A * 8/1970 Auerbach ..... 362/433
8,419,240 B2 * 4/2013 Lim ..... F21V 3/00 362/249.02
2004/0052082 A1 * 3/2004 Oswald ..... 362/457
(Continued)

FOREIGN PATENT DOCUMENTS

CN 101846260 A 9/2010
CN 201739866 U 2/2011
(Continued)

OTHER PUBLICATIONS

Official Communication issued in International Patent Application No. PCT/JP2012/068134, dated Oct. 23, 2012.

*Primary Examiner* — Anabel Ton
(74) *Attorney, Agent, or Firm* — Keating & Bennett, LLP

(57) ABSTRACT

One of a radiator plate (21) and a globe cover (13) is provided, on a part which makes contact with the other one, with a plurality of cutout sections (41), and the other one is provided, at positions corresponding to the respective cutout sections (41), with a plurality of projections (31). By engaging the cutout sections (41) and the projections (31), the globe cover (13) is attached to the radiator plate (21). This makes it possible to prevent, for a long term, the globe cover (13) which encloses a light source so as to cover the light source from being detached.

4 Claims, 11 Drawing Sheets

(56) References Cited

U.S. PATENT DOCUMENTS

| | | | | |
|---|---|---|---|---|
| 2008/0192488 | A1* | 8/2008 | Lai | A47G 33/08 362/362 |
| 2010/0171404 | A1* | 7/2010 | Liu et al. | 313/46 |
| 2011/0101861 | A1* | 5/2011 | Yoo | 315/35 |
| 2011/0292653 | A1* | 12/2011 | Hofmann et al. | 362/235 |
| 2012/0025706 | A1* | 2/2012 | Wang et al. | 315/35 |
| 2012/0127733 | A1* | 5/2012 | Tomiyoshi | F21V 3/02 362/363 |
| 2012/0187818 | A1* | 7/2012 | Chuang | F21V 29/83 313/46 |

FOREIGN PATENT DOCUMENTS

| | | | |
|---|---|---|---|
| JP | 2-91107 | U | 7/1990 |
| JP | 2004-186091 | A | 7/2004 |
| JP | 2008-270174 | A | 11/2008 |
| JP | 2009-289697 | A | 12/2009 |
| JP | 2011-134665 | A | 7/2011 |

* cited by examiner

ILLUMINATION DEVICE

TECHNICAL FIELD

The present invention relates to an illumination device including a light-transmitting cover member which encloses a light source so as to cover the light source.

BACKGROUND ART

Conventionally, illumination devices including a light-transmitting cover member (e.g., a transparent or semi-transparent cover member) which encloses a light source so as to cover the light source have been widely used. Examples of this kind of illumination device encompass electrical bulbs, electrical lamps, etc. using a variety of light sources such as LEDs, filaments, and cold cathode tubes.

For example, Patent Literature 1 discloses a lamp including a member which has a peripheral wall and a light source attachment section that are integrally molded from aluminum. The peripheral wall has a cylindrical shape, and the light source attachment section is disposed so as to close one end of the peripheral wall in an axial direction of the peripheral wall. The member is provided with a cover attachment groove at a portion where the peripheral wall and the light source attachment section are integrally continuous with each other (along a periphery of the light source attachment section). The cover attachment groove has a circular shape and is exposed to an outside. A light source cover is attached to the member by fitting a circular opening edge of the light source cover to the cover attachment groove and bonding them with the use of an adhesive.

CITATION LIST

Patent Literature 1

Japanese Patent Application Publication, Tokukai, No. 2009-289697 A (Publication Date: Dec. 10, 2009)

SUMMARY OF INVENTION

Technical Problem

However, the technique of Patent Literature 1 has a risk of fall of the light source cover, for example, due to a degradation of the adhesive caused by long-term use or the like. Specifically, according to the technique of Patent Literature 1, in which the circular opening edge of the light source cover is fitted to the cover attachment groove and the fitted state is maintained by the adhesive, a degradation of the adhesive leads to a risk of failure to support weight of the light source cover and fall of the light source cover. Furthermore, there is a risk of disengagement of the light source cover from the cover attachment groove due to a force applied to the light source cover in an attempt to detach the illumination device in a state where the adhesive has deteriorated. Especially in an arrangement in which an LED is used as a light source of the illumination device, the above problem is more likely to occur because such an illumination device has a far longer lifetime than a conventional illumination device using a filament and is more likely to suffer from an aging degradation of an adhesive at a late stage of use.

The present invention was accomplished in view of the above problems, and an object of the present invention is to provide an illumination device which makes it possible to stably prevent, for a long term, a cover member which encloses a light source so as to cover the light source from falling off.

Solution to Problem

An illumination device of the present invention includes: a housing section having a cylindrical shape; a top plate section attached to one end of the housing section, the top plate section being formed separately from the housing section; a light source section provided on the top plate section; and a cover member disposed so as to cover the light source section and the top plate section, the cover member having light transmittance, at least one of the top plate section and the cover member having at least one engaging section which is provided in a part facing the other one, and the other one having at least one engaged section which is provided in a position corresponding to the at least one engaging section, and the cover member being attached to the top plate section by causing the at least one engaging section and the at least one engaged section to be engaged with each other so that movement of the cover member in an axial direction of the housing section is restricted.

Advantageous Effects of Invention

According to the illumination device of the present invention, it is possible to provide an illumination device which makes it possible to stably prevent, for a long term, a cover member from falling off.

BRIEF DESCRIPTION OF DRAWINGS

FIG. 1 (*b*) is a perspective view illustrating a radiator plate provided in the illumination device illustrated in FIG. 1 (*a*).

FIG. 4 (*b*) is a top view illustrating the radiator plate and the radiator member illustrated in FIG. 4 (*a*).

FIG. 5 (*b*) is a plan view illustrating a bottom surface of the globe cover illustrated in FIG. 5 (*a*).

FIG. 6 (*b*) is a top view illustrating the radiator plate and the radiator member illustrated in FIG. 6 (*a*).

FIG. 7 (*b*) is a plan view illustrating a bottom surface of the globe cover illustrated in FIG. 7 (*a*).

FIG. 7 (*c*) is a perspective view illustrating how the globe cover illustrated in FIG. 7 (*a*) and FIG. 7 (*b*) is configured around a cutout section of the globe cover.

FIG. 8 (*b*) is a top view illustrating the radiator plate and the radiator member illustrated in FIG. 8 (*a*).

FIG. 9 (*b*) is a cross-sectional view taken along the B-B line illustrated in FIG. 6 (*b*).

FIG. 10 (*b*) is a cross-sectional view taken along the E-E line illustrated in FIG. 10 (*a*).

FIG. 11 (*b*) is a top view illustrating the radiator plate and the radiator member illustrated in FIG. 11 (*a*).

DESCRIPTION OF EMBODIMENTS

Embodiment 1

An embodiment of the present invention is described below.

(1-1. Overall Configuration of Illumination Device 10)

Figure 2:
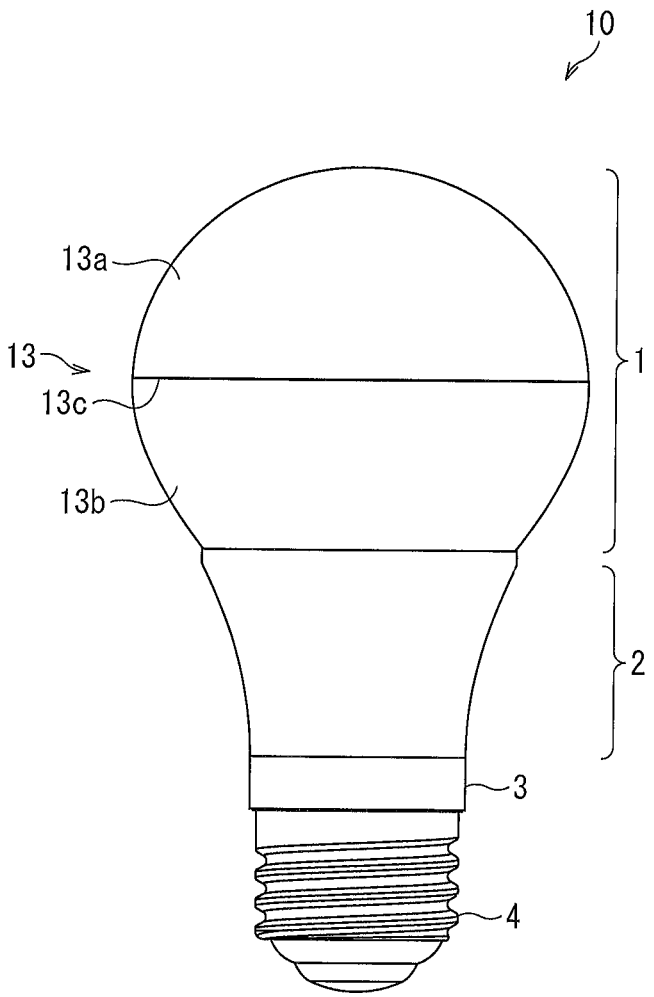
FIG. 2 is a plan view illustrating an overall configuration of the illumination device of the embodiment of the present invention.
Figure 3:
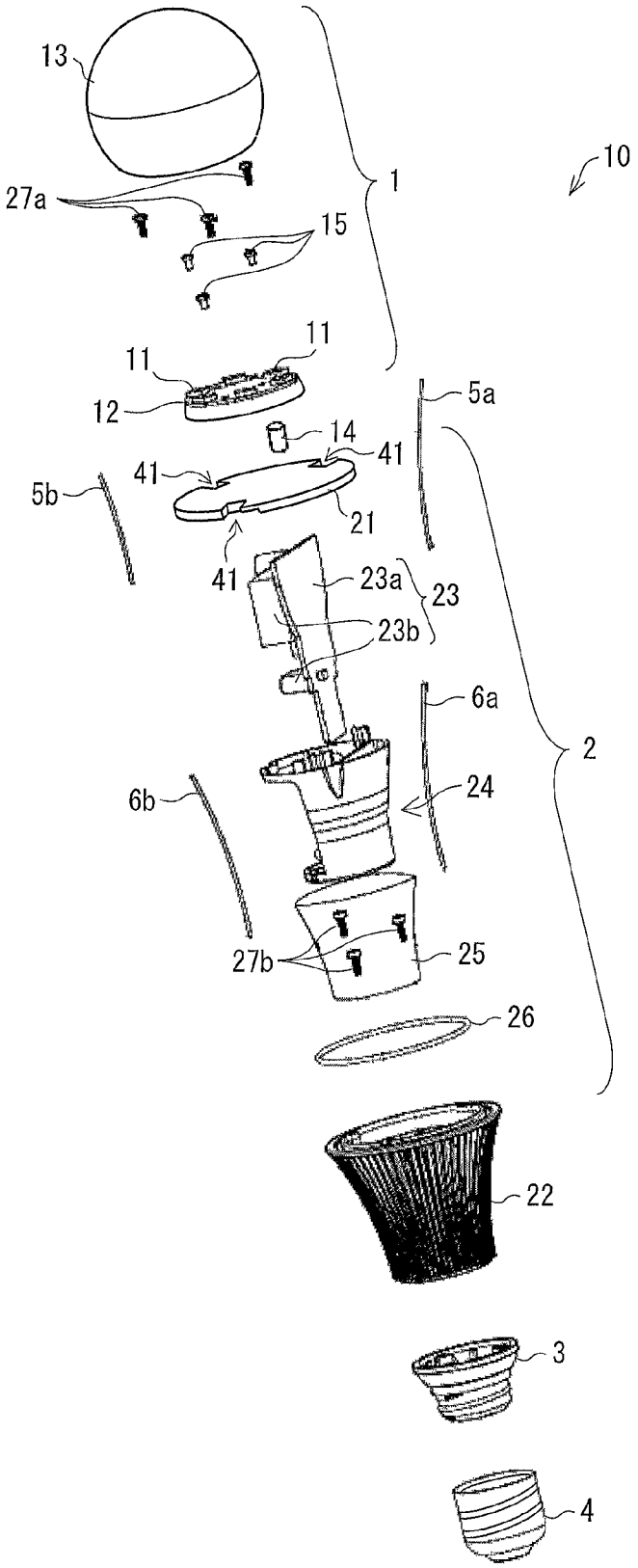
FIG. 3 is an exploded perspective view illustrating the illumination device illustrated in FIG. 2.

FIG. 2 is a side view illustrating an illumination device 10 of the present embodiment. FIG. 3 is an exploded perspective view illustrating the illumination device 10 of the present embodiment.

As illustrated in FIG. 2, the illumination device 10 includes a light-emitting section 1, a support section 2, an insulating ring 3, and a base 4 that are disposed in this order.

As illustrated in FIG. 3, the light-emitting section 1 includes a plurality of LEDs (light source section) 11, each of which serves as a light source, an LED substrate (light source section) 12 on which the LEDs 11 are mounted, and a globe cover (cover member) 13 which covers the LEDs 11 and the LED substrate 12. In the present embodiment, a disc-shaped ceramic substrate is used as the LED substrate 12. On the LED substrate 12, the plurality of LEDs 11 are substantially evenly disposed.

The globe cover 13 has such a shape that a part of a hollow sphere (ball-shape, three-dimensional shape) is cut off along a plane parallel to a plane passing through a center of the sphere. The globe cover 13 is attached to a radiator plate (top plate section) 21 (later described) so as to cover the LEDs 11 and the LED substrate 12 (details of a portion where the globe cover 13 is attached to the radiator plate 21 will be described later).

The globe cover 13 has a function of protecting the LEDs 11 and the LED substrate 12 and a function of transmitting or diffusing light emitted by the LEDs 11. A material of the globe cover 13 is not limited to a specific one, but is preferably a material having heat resistance enough to prevent large deformation, alteration, etc. from occurring due to heat generated by lighting the LEDs 11. For example, synthetic resin or glass can be used as the material of the globe cover 13. In the present embodiment, the globe cover 13 is made of a milky polycarbonate resin, which is a material excellent in impact resistance, heat resistance, and light diffusion. In the present embodiment, as illustrated in FIG. 2, an upper part (separate member) 13*a* and a lower part (separate member) 13*b* are separately formed by molding the polycarbonate resin, and then the upper part 13*a* and the lower part 13*b* are bonded to each other on a joint plane 13*c* to form the globe cover 13. A method for bonding the upper part 13*a* and the lower part 13*b* to each other is not limited to a specific one. For example, the upper part 13*a* and the lower part 13*b* may be bonded to each other by welding or may be bonded to each other with the use of an adhesive.

The support section 2 is a main body of the illumination device 10. As illustrated in FIG. 2, the light-emitting section 1 is attached to one end (upper end) of the support section 2, and the insulating ring 3 (connecting member) is attached to the other end (lower end) of the support section 2. As illustrated in FIG. 3, the support section 2 includes the radiator plate (top plate section) 21, a radiator member (housing section) 22, a power supply module 23, a holder 24, a potting resin section 25, and an O-ring 26.

The radiator plate 21 is a disc-shaped member which serves as a partition between the light-emitting section 1 and the support section 2. The radiator plate 21 is attached to the radiator member 22 so as to cover an opening, at one end, of the cylindrical radiator member 22. A diameter of the radiator plate 21 is identical to or slightly smaller than an internal diameter of an opening edge section 13*d* of the globe cover 13. The radiator plate 21 allows heat generated in the light-emitting section 1 (the LEDs 11, the LED substrate 12) to be radiated to an outside or transmitted to the radiator member 22. On a top surface of the radiator plate 21, the LED substrate 12 is fixed with the use of screws 15. The radiator plate 21 has a plurality of cutout sections 41 on an outer peripheral part. The cutout sections 41 are used to engage the globe cover 13 with the radiator plate 21 (details of the portion where the globe cover 13 is attached to the radiator plate 21 will be described later).

A material of the radiator plate 21 is not limited to a specific one, provided that it is a material having high heat conductivity, and can be, for example, a metal such as aluminum (Al), copper (Cu), iron (Fe), or nickel (Ni); an alloy of these metals; an industrial material such as aluminum nitride (AlN) or silicon carbide (SiC); or a synthetic resin such as a high thermal conductive resin. In the present embodiment, the whole of the radiator plate 21, including the cutout sections 41, is formed by casting (molding) aluminum.

The radiator member 22 is a cylindrical hollow member in which the holder 24 holding the power supply module 23 is to be stored. The radiator member 22 allows heat generated from heat sources such as the LEDs 11 and the power supply module 23 to be radiated to an outside of the illumination device 10. On a peripheral part of a top surface of the radiator member 22, the O-ring 26 is provided. This allows the radiator plate 21 to be fitted in close contact with the top surface of the radiator member 22. Alternatively, the radiator plate 21 may be fixed to the radiator member 22 by a screw, welding, or the like. Meanwhile, to a lower end of the radiator member 22, the insulating ring 3 is attached. A material of the radiator member 22 is preferably a material having high heat conductivity as with the radiator plate 21, and can be, for example, a metal such as aluminum (Al), copper (Cu), iron (Fe), or nickel (Ni); an alloy of these metals; an industrial material such as aluminum nitride (AlN) or silicon carbide (SiC); or a synthetic resin such as a high thermal conductive resin. In the present embodiment, the radiator member 22 is produced by casting (molding) aluminum. Note that, in the present embodiment, the radiator plate 21 and the radiator member 22 are produced by respective different molding steps, and then the radiator plate 21 is attached to the radiator member 22.

The power supply module 23 includes a power supply circuit board 23*a*, which is a printed board having a wire, and a plurality of electronic components 23*b* mounted on both surfaces of the power supply circuit board 23*a*. The electronic components 23*b* carry out, for example, power supply to the light-emitting section 1 (the LEDs 11, the LED substrate 12) and control of a lighting state (a color or emitted light, an amount of emitted light, etc.) of the LEDs 11. The power supply circuit board 23*a* is preferably made of a metal, such as aluminum, having good heat conductivity in order to achieve high heat radiation. However, a material of the power supply circuit board 23*a* is not limited to this, and can be, for example, a non-metal material, such as a glass epoxy material, or ceramics. The electronic components 23*b* are an electrolytic capacitor, a ceramic capacitor, a current transformer, a film capacitor, an REC (rectifier cell, diode bridge), a resistor, a transistor, a switching element, and the like. The electronic components 23*b* control ON/OFF of the LEDs 11 and modulate light or color of the LEDs 11. Note that the power supply module 23 is mounted inside the holder 24, and is stored in the radiator member 22 together with the holder 24.

The holder 24 is a holder for holding therein the power supply module 23. The holder 24 has an opening through a side surface thereof, and the power supply module 23 is disposed so that the electronic components 23*b* face this opening. This allows heat generated in the electronic components 23*b* to be efficiently transmitted to the radiator member 22 via the opening. The holder 24 is stored in the radiator member 22 while holding therein the power supply module 23. The radiator plate 21 is fixed to one end of the holder 24 with the use of screws 27*a*, and the insulating ring 3 is fixed to the other end of the holder 24 with the use of screws 27*b*. Note that the holder 24 is made of a material having an electrical insulating property and heat conductivity, and can be, for example, PBT (polybutylene terephthalate), acrylic resin, ABS resin, or polyamide resin.

The potting resin section 25 is provided in an internal space formed by the support section 2 and the insulating ring 3. This allows the power supply module 23 to be electrically insulated and be fixed inside the radiator member 22. Further, the potting resin section 25 transmits, to the radiator member 22, heat generated from the power supply module 23 in the support section 2 and heat generated from the LEDs 11. On this account, the potting resin section 25 is preferably made of a resin having high heat conductivity. Further, the potting resin section 25 preferably has an electrical insulating property and heat resistance in addition to high heat conductivity. For example, a synthetic resin such as a silicone resin, an epoxy resin, or a urethane resin is suitable as a material of the potting resin section 25.

The insulating ring 3 is made of an electrical insulating material, and an upper end of the insulating ring 3 is attached to a lower end of the radiator member 22. The insulating ring 3 is provided with a screw thread on an outer side surface thereof, and is threadably mounted inside the base 4 so as to be connected to the base 4. Specifically, the base 4 is provided with a screw thread which is engaged with the screw thread provided on the outer side surface of the insulating ring 3. This allows the insulating ring 3 to be threadably mounted in the base 4 so as to be connected to the base 4.

The base 4 is a metal fitting for external connection via which the illumination device 10 is attached to an installation portion, and is, for example, a general E26 type metal fitting. The base 4 is provided, on the outer side surface thereof, with a spiral screw thread, which is threadably mounted in a socket provided in the installation portion. This attaches the illumination device 10 to the installation portion. Further, the base 4 has a function of supplying, to the power supply module 23, power supplied from an external power supply (not illustrated).

The illumination device 10 includes two pairs of electric wires (electric wires 5*a* and 5*b* and electric wires 6*a* and 6*b*). One end of the pair of electrodes 5*a* and 5*b* is connected to the power supply module 23, and the other end of the pair of electrodes 5*a* and 5*b* is connected to the LED substrate 12 via a through-hole (not illustrated) provided through the radiator plate 21 and a sleeve 14 provided on a top surface (surface facing the light-emitting section 1) of the radiator plate 21. Meanwhile, the pair of electrodes 6*a* and 6*b* are power feeder wires for feeding power to the power supply module 23. One end of the pair of electrodes 6*a* and 6*b* is connected to the power supply module 23, and the other end of the pair of electrodes 6*a* and 6*b* is connected to the base 4 via insides of the support section 2 (the holder 24 and the radiator member 22) and the insulating ring 3. Note that an end of the electric wire 6*a* on the base 4 side is connected (temporarily bonded) to an eyelet section of a bottom section of the base 4, and an end of the electric wire 6*b* on the base 4 side is soldered to an inner side surface of the base 4.

With such an arrangement, by threadably attaching the base 4 of the illumination device 10 to a socket connected to a power supply source (e.g., commercial power supply), power is supplied to the power supply module 23 via the electric wires 6*a* and 6*b* connected to the base 4. Thus, appropriate power is supplied to the LED substrate 12 via the electric wires 5*a* and 5*b*, thereby allowing the LEDs 11 (the illumination device 10) to be lit.

(1-2. Configuration of Portion where Globe Cover 13 is Attached)

Figure 1:
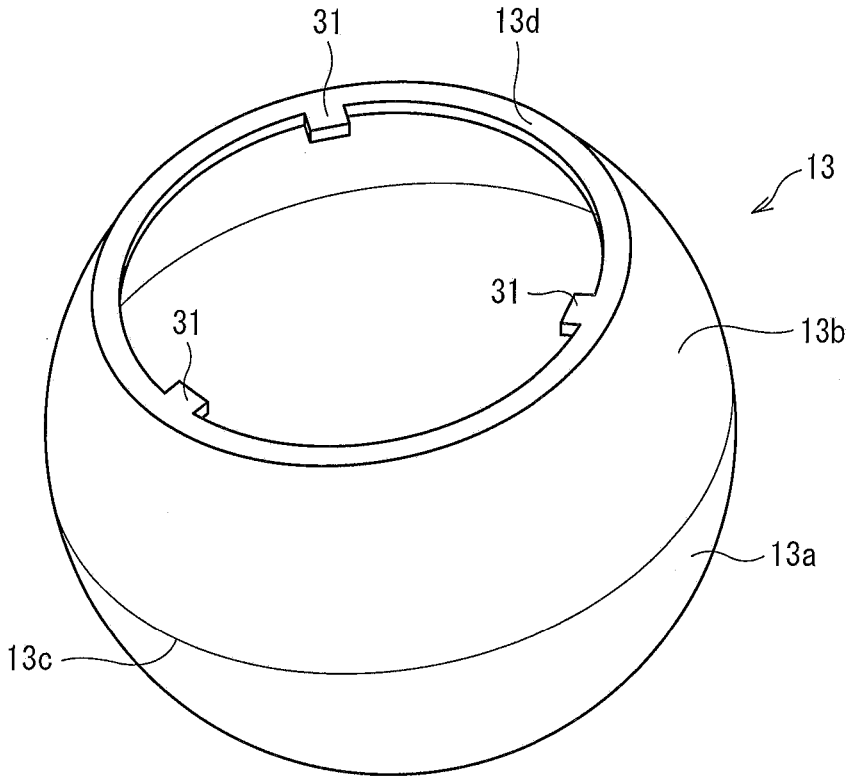
FIG. 1 (*a*) is a perspective view illustrating a globe cover provided in an illumination device of an embodiment of the present invention.
Figure 1:
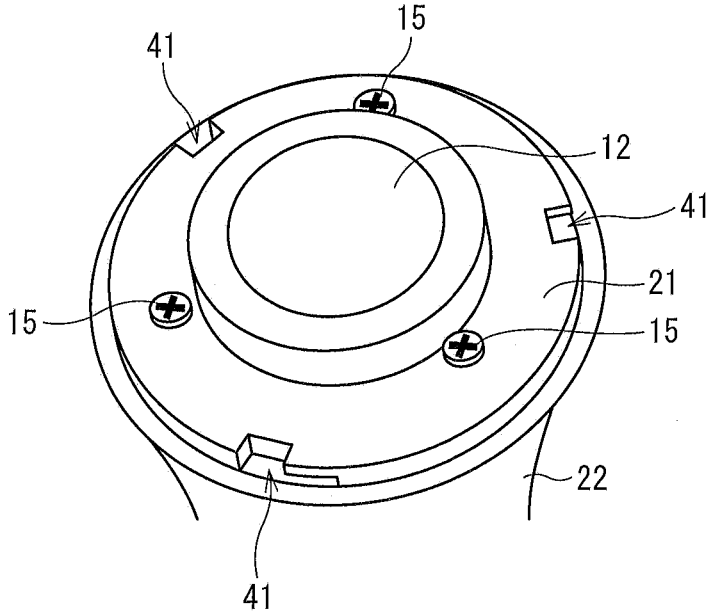
Figure 4:
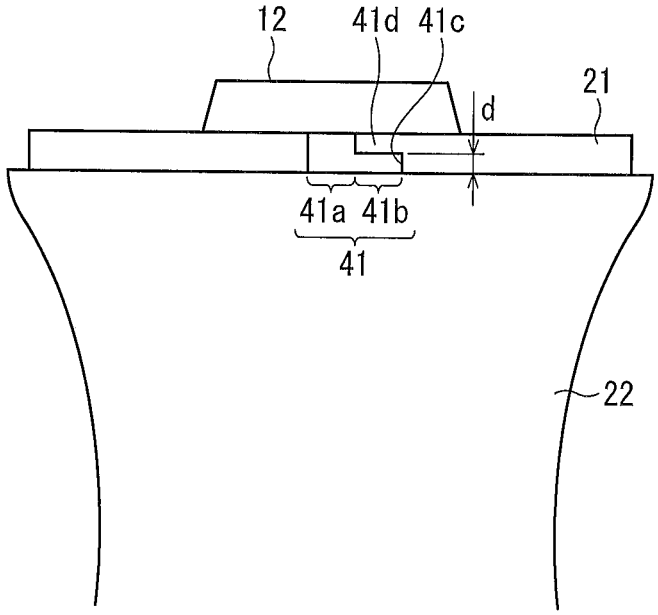
FIG. 4 (*a*) is a side view illustrating a radiator plate and a radiator member that are provided in the illumination device illustrated in FIG. 2.
Figure 4:
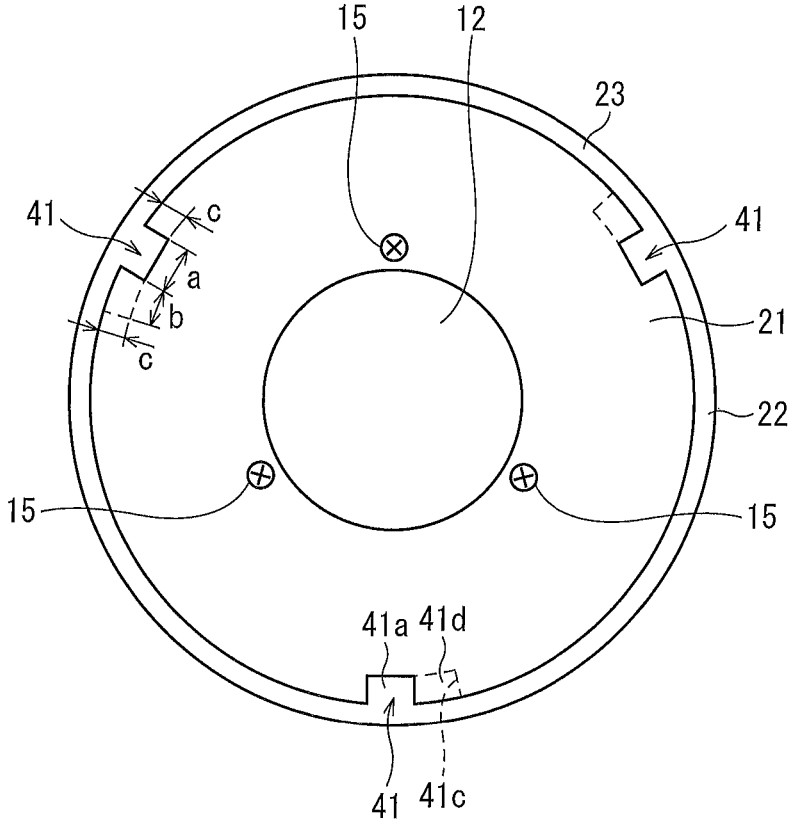

Next, the following describes details of the portion where the globe cover 13 is attached to the radiator plate 21. FIG. 1 (*a*) and FIG. 1 (*b*) are perspective views illustrating the globe cover 13 and the radiator plate 21, respectively. FIG. 4 (*a*) and FIG. 4 (*b*) are a side view and a top view illustrating the radiator plate 21 that has been attached to the radiator member 22, respectively.

As illustrated in FIG. 1 (*a*), the opening edge section 13*d* of the globe cover 13, which opening edge section 13*d* faces the radiator plate 21, is provided with a plurality of (in the present embodiment, three) rectangle-shaped projections 31 protruding inwardly in a radial direction of a circle formed by the opening edge section 13*d*. Specifically, as described above, the globe cover 13 has such a shape that a part of a hollow sphere (ball shape) is cut off along a cut plane parallel to a plane passing through a center of the sphere. This forms the opening edge section 13*d*, which is substantially circular and faces the radiator plate 21. The opening edge section 13*d* has a plurality of rectangle-shaped projections 31 which are provided in a circumferential direction and protrude inwardly in a radial direction of a circle formed by the opening edge section 13*d* so as to be substantially parallel to the cut plane. Note that the projections 31 may be evenly spaced apart from each other or may be unevenly spaced apart from each other.

In general, in a case where a globe cover made of a resin material is used, the entire globe cover is formed by one (1) molding process. However, according to this method, it is difficult to provide projections (such as the projections 31) protruding inwardly in a radial direction of the opening edge section 13*d*. Specifically, it is difficult to provide such projections because when a mold disposed for the molding process in (inside) the globe cover is removed, the projections interfere with the mold. Further, in a case where a globe cover made of glass is used, it is difficult to provide projections having sufficient strength. On the other hand, in the present embodiment, the upper part 13*a* and the lower part 13*b* of the globe cover 13 are separately formed by molding, and then the upper part 13*a* and the lower part 13*b* are bonded to each other on the joint plane 13*c* to form the globe cover 13. Note that the upper part 13*a* and the lower part 13*b* are separately molded so that the joint plane 13*c* passes through a substantially center of the spherical globe cover 13 after the bonding. This makes it possible to prevent the projections from interfering with a metal fitting when the metal fitting is removed and to easily form the projections 31.

In the present embodiment, the globe cover 13, which serves as a cover member, is constituted by the upper part 13*a* and the lower part 13*b* so as to form a spherical shape. Note, however, that a shape of the globe cover 13 is not limited to a spherical shape, and can be, for example, a hemispherical shape. Note also that the present embodiment is not limited to an arrangement in which the globe cover 13 is produced by separately molding a plurality of separate members. The globe cover 13 may be molded integrally.

As illustrated in FIG. 1 (*b*), FIG. 4 (*a*), and FIG. 4 (*b*), the peripheral part of the radiator plate 21 is provided with cutout sections (engaged sections) 41, which are formed by cutting out parts of the peripheral part, at positions corresponding to the respective projections (engaging sections) 31 of the globe cover 13.

Specifically, each of the cutout sections 41 has (i) a first cutout section (inserted section) 41*a* which penetrates the disc-shaped radiator plate 21 from the top surface side to the bottom surface side and is opened on an outside of the periphery of the radiator plate 21 in the radial direction and (ii) a second cutout section (storing section) 41*b* which extends from a part of the first cutout section 41*a* in a direction parallel to an in-plane direction of the radiator plate 21 so as to be continuous with the part of the first cutout section 41*a*. More specifically, at a position adjacent to the first cutout section 41*a* in a counterclockwise direction when the radiator plate 21 is viewed from above, a protecting section (axial direction movement restricting section) 41*d* whose top surface is substantially flush with the top surface of the radiator plate 21 and which is thinner than the radiator plate 21 is provided. Furthermore, a region of the protecting section 41*d* on the bottom surface side of the radiator plate 21 is opened on the bottom surface side of the radiator plate 21 and on an outside of the periphery of the radiator plate 21 in the radial direction. This forms the second cutout section 41*b* between the protecting section 41*d* and the radiator member 22. By attaching the radiator plate 21 to the radiator member 22, the second cutout section 41*b* is formed in a groove-shape between the radiator plate 21 and the radiator member 22.

A width a of the first cutout section 41*a* along the circumferential direction of the radiator plate 21 is identical to or slightly larger than a width of the projection 31 of the globe cover 13 in the circumferential direction of the circle formed by the opening edge section 13*d*. A width c of the first cutout section 41*a* and the second cutout section 41*b* in the radial direction of the radiator plate 21 is identical to or slightly larger than a width of the projection 31 of the globe cover 13 in the radial direction of the circle formed by the opening edge section 13*d*. A height d of the second cutout section 41*b* in a direction perpendicular to the in-plane direction of the radiator plate 21, i.e., a difference between a thickness of the radiator plate 21 and a thickness of the protecting section 41*d* is identical to or slightly larger than a width of the projection 31 of the globe cover 13 in a direction perpendicular to a plane including the opening edge section 13*d*. A blocking section (rotation restricting section) 41*c* is provided on an end of the second cutout section 41*b* which end is opposite to the first cutout section 41*a*. A depth b of the second cutout section 41*b* from the first cutout section 41*a* (a distance from the first cutout section 41*a* to the blocking section 41*c*) is equal to or larger than a width of the projection 31 of the globe cover 13 in the circumferential direction of the opening edge section 13*d*.

With the arrangement, by rotating the globe cover 13 in an attachment direction (in the present embodiment, a counterclockwise direction when viewed from the top surface side of the radiator plate 21) along the in-plane direction (circumferential direction) of the radiator plate 21 after inserting the projections (engaging section) 31 of the globe cover 13 into the respective first cutout sections (inserted section) 41*a* of the corresponding cutout sections (engaged section) 41 of the radiator plate 21, the projections 31 are stored in the respective second cutout sections (storing section) 41*b* of the corresponding cutout sections (engaged section) 41, thereby engaging the globe cover 13 with the radiator plate 21. Accordingly, in a state in which the projections 31 are engaged with the respective cutout sections 41, movement of the projections 31 in a direction (the axial direction of the radiator member 22) perpendicular to the in-plane direction of the radiator plate 21 is restricted by the protecting section (axial direction movement restricting section) 41*d* and the top surface of the radiator member 22. The protecting section 41*d* thus prevents the globe cover 13 from falling even if an adhesive (later described) for bonding the globe cover 13 and the radiator plate 21 deteriorates.

In addition, rotation of the globe cover 13 in the attachment direction beyond a predetermined engagement position by more than a predetermined angle is restricted since the blocking section (rotation restricting section) 41*c* is provided at the end of the second cutout section 41*b*. By thus providing the blocking section 41*c* so that it restricts rotation in a direction in which the base 4 of the illumination device 10 is removed from a socket (the counterclockwise direction when viewed from the top surface side of the radiator plate 21), it is possible to prevent the globe cover 13 from coming out of the radiator plate 21 due to force applied, in a direction in which the illumination device 10 is removed, to the globe cover 13, for example, in an attempt to remove the illumination device 10 after long-term use, even if adhesive power of the adhesive (later described) has decreased.

In the present embodiment, the first cutout sections 41*a* penetrate the radiator plate 21 from the top surface to the bottom surface. Note, however, that the present embodiment is not limited to this. It is only necessary that the first cutout sections 41*a* be opened at least on the top surface side of the radiator plate 21. In the present embodiment, the second cutout sections 41*b* are opened on the bottom surface side of the radiator plate 21. Note, however, that the present embodiment is not limited to this. The second cutout sections 41*b* may be closed on the bottom surface side of the radiator plate 21. It is only necessary that the second cutout sections 41*b* be closed at least on the top surface side of the radiator plate 21, for example, by the protecting sections 41*d* of the present embodiment (it is only necessary that the second cutout sections 41*b* be configured to restrict movement of the projections 31 stored in the respective second cutout sections 41*b* towards the top surface side of the radiator plate 21).

In the present embodiment, the globe cover 13 is attached to the radiator plate 21 not only by engaging the projections 31 of the globe cover 13 with the respective cutout sections 41 of the radiator plate 21, but also by bonding the globe cover 13 and the radiator plate 21 with an adhesive. A material of the adhesive is not limited to a specific one, but is preferably one having heat resistance and an electrical insulating property and having resistance against ultraviolet rays, moisture, etc. Examples of an adhesive having such properties encompass adhesives made of a silicone resin, an epoxy resin, and the like. A timing at which the adhesive is applied can be determined as appropriate according to a curing time etc. of the adhesive, and may be before engagement of the globe cover 13 and the radiator plate 21 or may be after engagement of the globe cover 13 and the radiator plate 21. A position at which the adhesive is applied is not limited to a specific one, provided that it includes at least part of at least one of opposing parts of the globe cover 13 and the radiator plate 21. It is, however, more preferable to apply the adhesive between the projections 31 and the radiator plate 21 so as to restrict movement of the projections 31 towards the side opposite to the blocking section 41*c*. This allows the radiator plate 21 to more tightly hold the globe cover 13.

In the present embodiment, the radiator plate 21 and the radiator member 22 are produced as separate members by respective separate molding steps, and then the radiator plate 21 is attached to the radiator member 22. This makes it possible to form the cutout sections 41 of the radiator plate 21 in the molding step for producing the radiator plate 21.

More specifically, in order to restrict movement of the projections 31 of the globe cover 13 in the axial direction of the radiator member 22, each of the cutout sections 41 is configured to have (i) the first cutout section 41*a* which is opened on the top surface side and the outside of the periphery of the radiator plate 21 and (ii) the second cutout section 41*b* which extends from a part of the first cutout section 41*a* in a direction substantially parallel to the in-plane direction of the radiator plate 21 so as to be continuous with the part of the first cutout section 41*a* and which is closed on the top surface side of the periphery of the radiator plate 21 by the protecting section 41*d* and is opened on the bottom surface side. Accordingly, in a case where the radiator plate 21 and the radiator member 22 are integrally formed by a single molding step, a mold used for the molding step cannot be pulled out in the axial direction of the radiator member 22 because parts of the mold that correspond to the second cutout sections 41*b* are stopped by the protecting sections 41*d* of the radiator plate 21. It is therefore conventionally difficult to form the cutout sections 41 configured as above by the molding step. Accordingly, in a case where the radiator plate 21 and the radiator member 22 are integrally formed by a single molding step, it is necessary to form the cutout sections 41 by a cutting process (machining process) after forming the radiator plate 21 and the radiator member 22 except for the cutout sections 41 by the molding step. This means an increase in the number of production steps, which invites an increase in production cost.

Note that in a case where the radiator plate 21 and the radiator member 22 are integrally formed by a single molding step, it is also thinkable to pull out the mold used for the molding step in a direction perpendicular to the axial direction of the radiator member 22. This is, however, difficult to achieve because the mold needs to be divided into pieces whose number corresponds to the number of cutout sections 41 (in the present embodiment, three) in order to prevent the mold from interfering with the cutout sections 41.

On the other hand, in the present embodiment, the radiator plate 21 and the radiator member 22 are produced by respective separate molding steps, and then the radiator plate 21 is attached to the radiator member 22. Accordingly, in the molding step for forming the radiator plate 21, a mold used for the molding step can be pulled out in a direction (corresponding to the axial direction of the radiator member 22) perpendicular to the in-plane direction of the radiator plate 21 without being stopped by the protecting sections 41*d*. It is therefore possible to form the entire radiator plate 21, including the cutout sections 41, by a single molding step. This makes it possible to easily produce the radiator plate 21, including the cutout sections 41, at low cost.

Embodiment 2

Another embodiment of the present invention is described below. For convenience of description, members that have identical functions to those of Embodiment 1 are given identical reference numerals, and are not explained repeatedly.

Embodiment 1 has dealt with an arrangement in which the globe cover 13 is provided with the projections 31 that protrude from the opening edge section 13*d* inwardly in the radial direction of the circle formed by the opening edge section 13*d*. Meanwhile, the present embodiment deals with an arrangement in which the globe cover 13 is provided, instead of the projections 31 of Embodiment 1, with projections that protrude from the opening edge section 13*d* outwardly in the radial direction of the circle formed by the opening edge section 13*d*.

Figure 5:
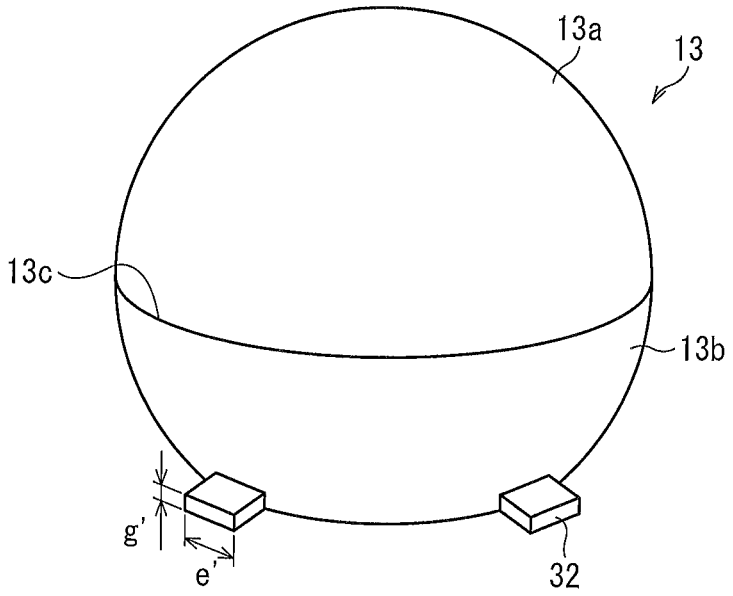
FIG. 5 (*a*) is a perspective view illustrating a globe cover provided in an illumination device of another embodiment of the present invention.
Figure 5:
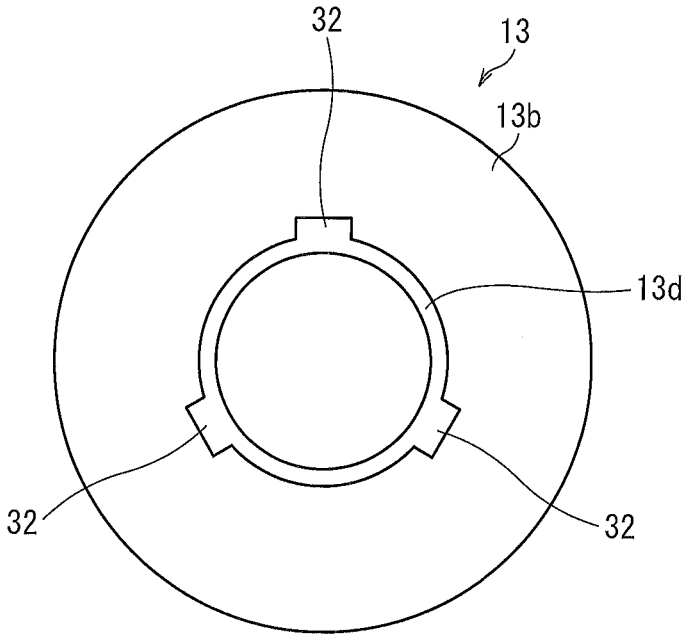
Figure 6:
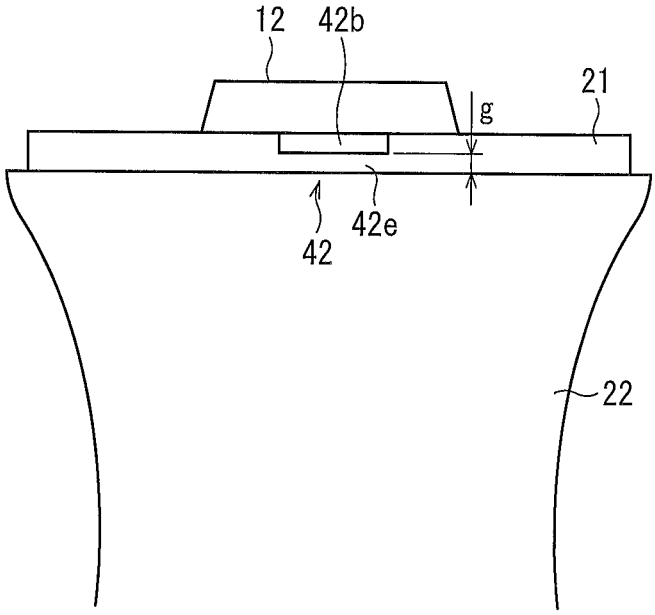
FIG. 6 (*a*) is a side view illustrating a radiator plate and a radiator member that are provided in the illumination device of the another embodiment of the present invention.
Figure 6:
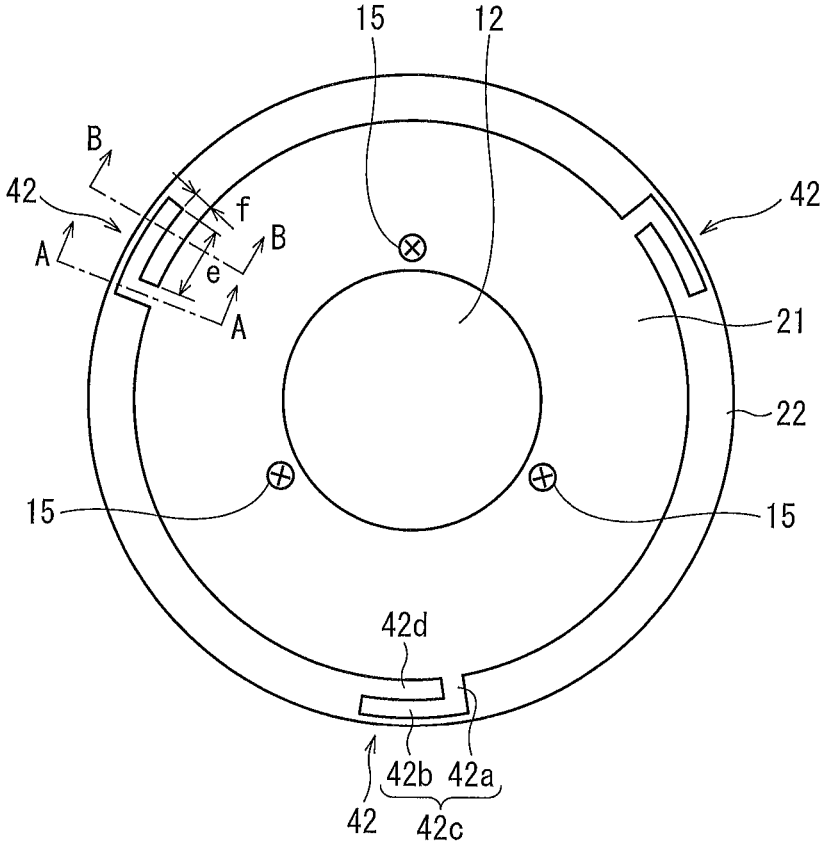
Figure 9:
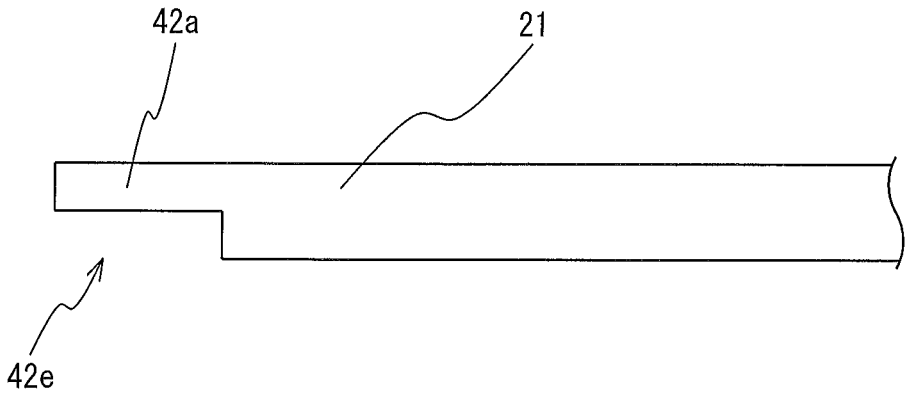
FIG. 9 (*a*) is a cross-sectional view taken along the A-A line illustrated in FIG. 6 (*b*).
Figure 9:
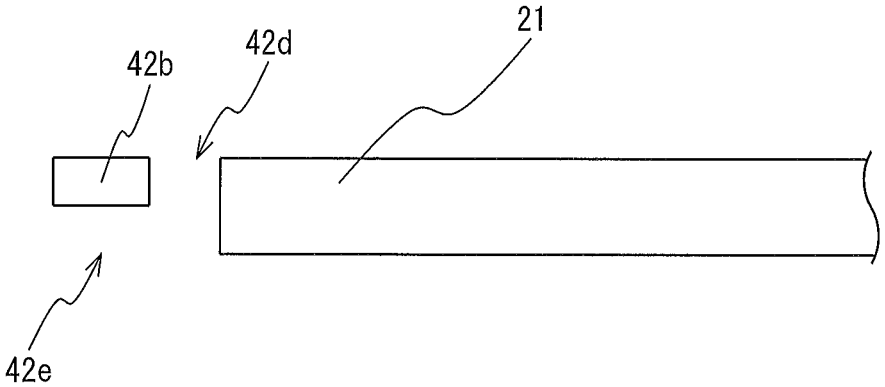

FIG. 5 (*a*) is a perspective view illustrating a globe cover 13 of the present embodiment, and FIG. 5 (*b*) is a plan view illustrating a bottom surface side of the globe cover 13. FIG. 6 (*a*) and FIG. 6 (*b*) are a side view and a top view illustrating a radiator plate 21 with which the globe cover 13 illustrated in FIG. 5 (*a*) and FIG. 5 (*b*) are to be engaged, respectively. FIG. 9 (*a*) is a cross-sectional view taken along the A-A line illustrated in FIG. 6 (*b*), and FIG. 9 (*b*) is a cross-sectional view taken along the B-B line illustrated in FIG. 6 (*b*).

As illustrated in FIG. 5 (*a*) and FIG. 5 (*b*), the globe cover 13 includes, instead of the projections 31 of the globe cover 13 of Embodiment 1, a plurality of projections (engaging section) 32 that protrude from an opening edge section 13*d* outwardly in a radial direction of a circle formed by the opening edge section 13*d*. Note that the projections 32 may be evenly spaced apart from each other or may be unevenly spaced apart from each other.

As illustrated in FIG. 6 (*a*), FIG. 6 (*b*), FIG. 9 (*a*), and FIG. 9 (*b*), a periphery of the radiator plate 21 is provided, at positions corresponding to the projections 32, with a plurality of grooves (engaged section) 42 to be engaged with the projections 32. Each of the grooves 42 includes a groove formation part 42*c* which has a first part (rotation restricting section) 42*a* protruding from the periphery of the radiator plate 21 outwardly in the radial direction and a second part (axial direction movement restricting section) 42*b* extending from an end of the first part 42*a* so as to face the periphery of the radiator plate 21. The second part 42*b* and the periphery of the radiator plate 21 face each other across a space corresponding to a thickness of the globe cover 13. This forms a first groove (inserted section) 42*d* between the second part 42*b* and the periphery of the radiator plate 21. A top surface of the second part 42*b* is flush with a top surface of the radiator plate 21, and a thickness of the second part 42*b* is thinner than that of the radiator plate 21 by a thickness corresponding to a thickness of the projection 31. This forms a second groove (storing section) 42*e* between the second part 42*b* and the top surface of the periphery of the radiator member 22.

Note that a length of the second part 42*b* along a circumferential direction of the radiator plate 21, i.e., a length e of the first groove 42*d* and the second groove 42*e* is identical to or larger than a length e' of the projection 32 along the circumferential direction of the opening edge section 13*d*. A width of the first groove 42*d* in the radial direction of the radiator plate 21 is identical to or larger than a thickness of a curved part of the globe cover 13. A space between the second part 42*b* and the top surface of the periphery of the radiator member 22, i.e., a depth g of the second groove 42*e* in a thickness direction of the radiator plate 21 is identical to or larger than a thickness g' of the projection 32.

With the arrangement, by rotating the globe cover 13 relative to the radiator member 22 and the radiator plate 21 in a state in which the opening edge section 13*d* of the globe cover 13 faces the top surface of the periphery of the radiator member 22, the projections 32 of the globe cover 13 are stored in and engaged with the respective second grooves (storing section) 42*e* formed between the second parts 42*b* and the radiator member 22. Movement of the projections 32 stored in the respective second grooves 42*e* in the axial direction of the radiator member 22 is restricted by the second parts (axial direction movement restricting section) 42*b*. Rotation of the projections 32 stored in the respective second grooves 42*e* beyond a predetermined engagement position by more than a predetermined angle is restricted by the first parts (rotation restricting section) 42*a*. As in Embodiment 1, the globe cover 13 is bonded to the radiator plate 21 in the engagement state with the use of an adhesive.

In the present embodiment, the radiator plate 21 and the radiator member 22 are produced by respective separate molding steps, and then the radiator plate 21 is attached to the radiator member 22. This allows the grooves 42 of the radiator plate 21 to be formed by a molding step for producing the radiator plate 21.

More specifically, in order to restrict movement of the projections 32 of the globe cover 13 in the axial direction of the radiator member 2, each of the grooves 42 has (i) the first part 42*a* protruding from the periphery of the radiator plate 21 outwardly in the radial direction and (ii) the second part 42*b* extending from an end of the first part 42*a* so as to face the periphery of the radiator plate 21, so that the first groove 42*d* is formed between the second part 42*b* and the periphery of the radiator plate 21 and the second groove (storing section) 42*e* is formed between a bottom surface of the second part 42*b* and the top surface of the periphery of the radiator member 22. Accordingly, in a case where the radiator plate 21 and the radiator member 22 are integrally formed by a single molding step, a mold used for the molding step cannot be pulled out in the axial direction of the radiator member 22 nor in a direction perpendicular to the axial direction because the mold is stopped by the second parts 42*b*. It is therefore conventionally difficult to form the cutout sections 41 configured as above by the molding step. Accordingly, in a case where the radiator plate 21 and the radiator member 22 are integrally formed by a single molding step, it is necessary to form the grooves 42 by a cutting process (machining process) of the radiator plate 21 after forming the radiator plate 21 and the radiator member 22 by the molding step. This means an increase in the number of production steps, which invites an increase in production cost.

On the other hand, in the present embodiment, the radiator plate 21 and the radiator member 22 are produced by respective separate molding steps, and then the radiator plate 21 is attached to the radiator member 22. Accordingly, in the molding step for forming the radiator plate 21, a mold used for the molding step is not stopped by the second parts 42*b*. It is therefore possible to form the entire radiator plate 21, including the grooves 42, by a single molding step. This makes it possible to easily produce the radiator plate 21, including the grooves 42, at low cost.

Embodiment 3

Still another embodiment of the present invention is described below. For convenience of description, members that have identical functions to those of Embodiments 1 and 2 are given identical reference numerals, and are not explained repeatedly.

Embodiment 2 has dealt with an arrangement in which (i) the globe cover 13 is provided with the projections 32 that protrude from the opening edge section 13*d* outwardly in the radial direction of the circle formed by the opening edge section 13*d* and (ii) the radiator plate 21 is provided with the grooves 42 disposed in an outside, in the radial direction, of the periphery of the radiator plate 21. On the other hand, the present embodiment deals with an arrangement in which (i) the opening edge section 13*d* of the globe cover 13 is provided with a plurality of projections whose ends protrude outwardly in a radial direction, (ii) the periphery of the radiator plate 21 is provided, at positions corresponding to the respective projections, with cutout sections that are cut out from the periphery of the radiator plate 21 inwardly in the radial direction, and (iii) the projections and the cutout sections are engaged with each other.

Figure 10:
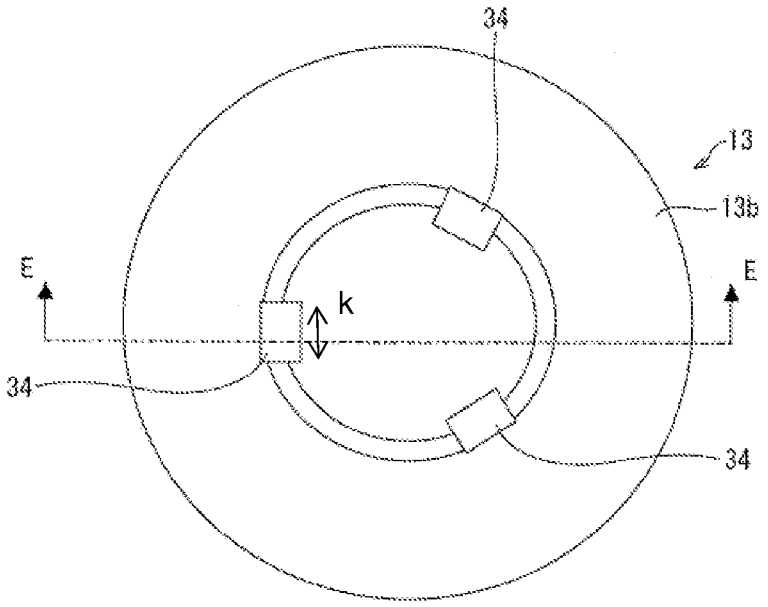
FIG. 10 (*a*) is a plan view illustrating a bottom surface of a globe cover provided in an illumination device of still another embodiment of the present invention.
Figure 10:
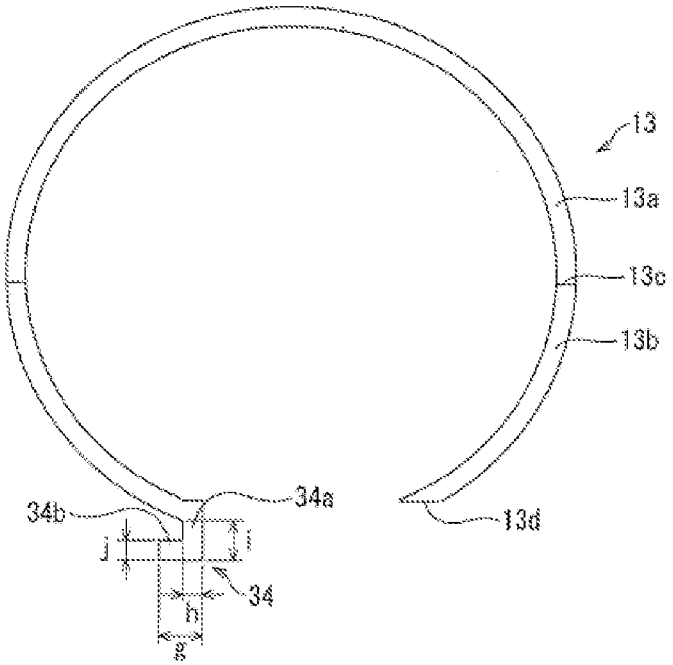
Figure 11:
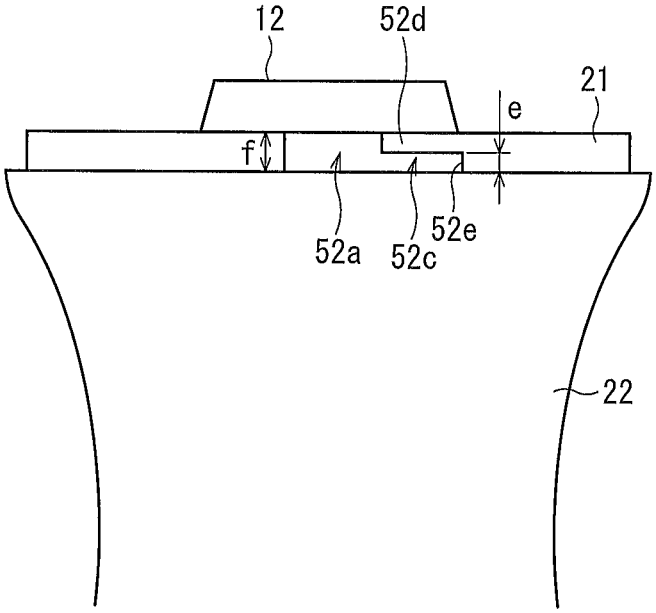
FIG. 11 (*a*) is a side view illustrating the radiator plate and the radiator member that are provided in the illumination device of the still another embodiment of the present invention.
Figure 11:
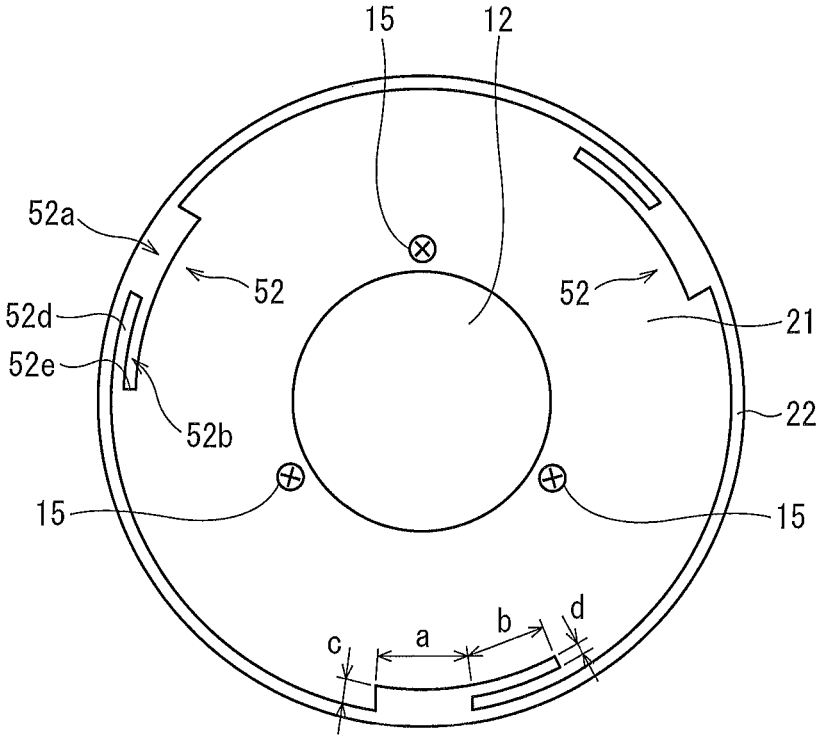

FIG. 10 (*a*) is a plan view illustrating a bottom surface of a globe cover 13 of the present embodiment, and FIG. 10 (*b*) is a cross-sectional view taken along the E-E line illustrated in FIG. 10 (*a*). FIG. 11 (*a*) and FIG. 11 (*b*) are a side view and a top view illustrating a radiator plate 21 with which the globe cover 13 illustrated in FIG. 10 (*a*) and FIG. 10 (*b*) is to be engaged, respectively.

As illustrated in FIG. 10 (*a*) and FIG. 10 (*b*), the globe cover 13 includes projections (engaging section) 34 instead of the projections 32 of the globe cover 13 of Embodiment 2. Each of the projections 34 has a first part 34*a* protruding from the opening edge section 13*d* downwards (in a direction pointing towards the radiator member 22 and perpendicular to a radial direction of a circle formed by the opening edge section 13*d*) and a second part 34*b* protruding from an end of the first part 34*a* outwardly in the radial direction of the circle formed by the opening edge section 13*d*.

As illustrated in FIG. 11 (*a*) and FIG. 11 (*b*), a periphery of the radiator plate 21 is provided, at positions corresponding to the respective projections 34, a plurality of cutout sections (engaged section) 52 to be engaged with the respective projections 34. Each of the cutout sections 42 includes a first cutout section (inserted section) 52*a*, a second cutout section (storing section) 52*b*, a third cutout section (storing section) 52*c*, and a protecting section 52*d*. The first cutout section 52*a* has such a shape that a part of the periphery of the radiator plate 21 is cut out inwardly in the radial direction. The first cutout section 52*a* penetrates the disc-shaped radiator plate 21 from the top surface side to the bottom surface side. The first cutout section 52*a* is opened on the outside of the periphery of the radiator plate 21 in the radial direction. The second cutout section 52*b* extends from a part of the first cutout section 52*a* in a direction substantially parallel to the periphery of the radiator plate 21 so as to be continuous with the part of the first cutout section 52*a*. As with the first cutout section 52*a*, the second cutout section 52*b* penetrates the radiator plate 21 from the top surface side to the bottom surface side. There provided a blocking section (rotation restricting section) 52*e* at an end of the second cutout section 52*b* which end is opposite to the first cutout section 52*a*. The protecting section 52*d* is disposed along the periphery of the radiator plate 21 so as to be adjacent to the second cutout section 52. The protecting section 52*d* has a top surface which is substantially flush with the top surface of the radiator plate 21, and has a thickness smaller than a thickness of the radiator plate 21. This forms, on the bottom surface side of the protecting section 52*d*, the third cutout section 52*c* which is continuous with the first cutout section 52*a* and the second cutout section 52*b* and which is opened on the bottom surface side and on the outside in the radial direction.

A length i of the first part 34*a* of the projection 34 from the opening edge section 13*d* to a tip of the first part 34*a* is the identical to or slightly larger than a thickness f of the radiator plate 21. A thickness j of the second part 34*b* is identical to or slightly smaller than a width e of the third cutout section 52*c* in a top-to-bottom direction (space between the bottom surface of the protecting section 52*b* and the top surface of the radiator member 22). A length g of the second part 34*b* from its connecting part with the first part 34*a* to its tip pointing outward in the radial direction is identical to or slightly larger than a width c of the first groove in the radial direction. A thickness h of the first part 52*a* is identical to or slightly smaller than a width d of the second cutout section 52*b* in the radial direction. A width a of the first cutout section 52*a* in the circumferential direction and a width b of the second cutout section 52*b*, the third cutout section 52*c*, and the protecting section 52*d* in the circumferential direction of the radiator plate 21 are identical to or slightly larger than a width k of the projection 34 in the circumferential direction of the circle formed by the opening edge section 13*d*.

With the arrangement, by rotating the globe cover 13 in an attachment direction (in the present embodiment, a counterclockwise direction when viewed from the top surface side of the radiator plate 21) along the in-plane direction (circumferential direction) of the radiator plate 21 after inserting the projections (engaging section) 34 of the globe cover 13 into the respective first cutout sections (inserted section) 52*a* of the corresponding cutout sections (engaged section) 52 of the radiator plate 21, the projections 34 are stored in the second cutout sections (storing section) 52*b* and the third cutout sections (storing section) 52*c* of the corresponding cutout sections (engaged section) 52, thereby engaging the globe cover 13 with the radiator plate 21. More specifically, the first parts 34*a* of the projections 34 are stored in the second cutout sections (storing section) 52*b*, and the second parts 34*b* of the projections 34 are stored in the third cutout sections (storing section) 52*c*. This allows movement of the projections 34 in a direction (the axial direction of the radiator member 22) perpendicular to the in-plane direction of the radiator plate 21 to be restricted by the protecting section (axial direction movement restricting section) 52*d* and the top surface of the radiator member 22 in a state in which the projections 34 are engaged with the respective cutout sections 52. As in Embodiments 1 and 2, the globe cover 13 is bonded to the radiator plate 21 in the engagement state with the use of an adhesive.

Furthermore, since the blocking section (rotation restricting section) 52*e* is provided at the end of the second cutout section 52*b*, rotation of the globe cover 13 in the attachment direction beyond a predetermined engagement position by more than a predetermined angle is restricted. By thus providing the blocking section 52*e* so that it restricts rotation in a direction in which a base 4 of an illumination device 10 is removed (a counterclockwise direction when viewed from the top surface side of the radiator plate 21), it is possible to prevent the globe cover 13 from coming out of the radiator plate 21 due to force applied, in a direction in which the illumination device 10 is removed, to the globe cover 13, for example, in an attempt to remove the illumination device 10 after long-term use, even if adhesive power of the adhesive (later described) has decreased.

In the present embodiment, the radiator plate 21 and the radiator member 22 are produced as separate members by respective separate molding steps, and then the radiator plate 21 is attached to the radiator member 22. This makes it possible to form the cutout sections 52 of the radiator plate 21 in the molding step for producing the radiator plate 21.

More specifically, each of the cutout sections 52 includes (i) the protecting section 52*b* formed along the periphery of the radiator plate 21, (ii) the third cutout section 53*c* provided between the bottom surface side of the protecting section 52*b* and the radiator member 22, and (iii) the second cutout section 52*b* provided in an inside of the protecting section 52*b* in the radial direction. Therefore, in a case where the radiator plate 21 and the radiator member 22 are integrally formed by a single molding step, a mold used for the molding step cannot be pulled out in the axial direction of the radiator member 22 because parts of the mold that correspond to the third cutout sections 52*c* are stopped by the protecting sections 52*d* of the radiator plate 21. Moreover, the mold used for the molding step cannot be pulled out in the radial direction of the radiator member 22 because parts of the mold that correspond to the second cutout sections 52*b* are stopped by the protecting sections 52*d* of the radiator plate 21. Accordingly, in a case where the radiator plate 21 and the radiator member 22 are integrally formed by a single molding step, it is necessary to form the cutout sections 52 by a cutting process (machining process) after forming the radiator plate 21 and the radiator member 22 except for the cutout sections 52 by the molding step. This means an increase in the number of production steps, which invites an increase in production cost.

On the other hand, in the present embodiment, the radiator plate 21 and the radiator member 22 are produced by respective separate molding steps, and then the radiator plate 21 is attached to the radiator member 22. Accordingly, in the molding step for forming the radiator plate 21, a mold used for the molding step is not stopped by the protecting sections 52*d*. It is therefore possible to form the entire radiator plate 21, including the cutout sections 52, by a single molding step. This makes it possible to easily produce the radiator plate 21, including the cutout sections 52, at low cost.

Embodiment 4

Another embodiment of the present invention is described below. For convenience of description, members that have identical functions to those of Embodiments 1 through 3 are given identical reference numerals, and are not explained repeatedly.

Embodiments 1 through 3 have dealt with an arrangement in which the opening edge section 13*d* of the globe cover 13 is provided with the projections (engaging section) 31, 32, and 34 and the radiator plate 21 is provided with the cutout sections (engaged section) 41, the grooves (engaged section) 42, and the cutout sections 52. In the present embodiment, the globe cover 13 is provided with cutout sections (engaged section) and the radiator plate 21 is provided with projections (engaging section).

Figure 7:
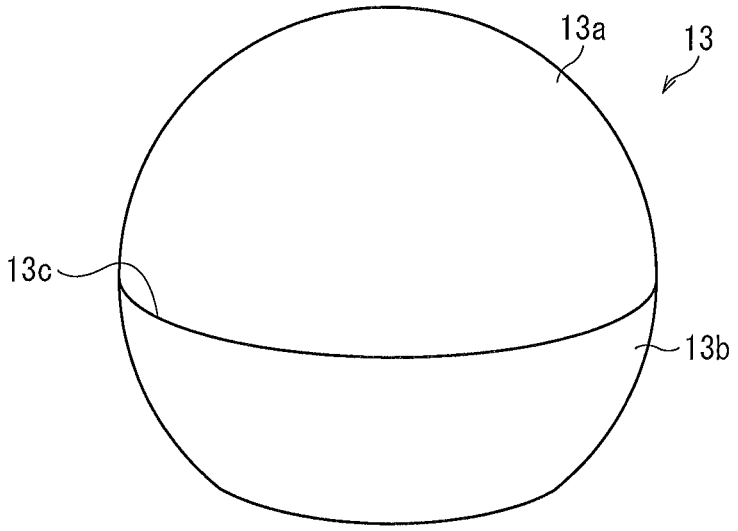
FIG. 7 (*a*) is a perspective view illustrating a globe cover provided in an illumination device of still another embodiment of the present invention.
Figure 7:
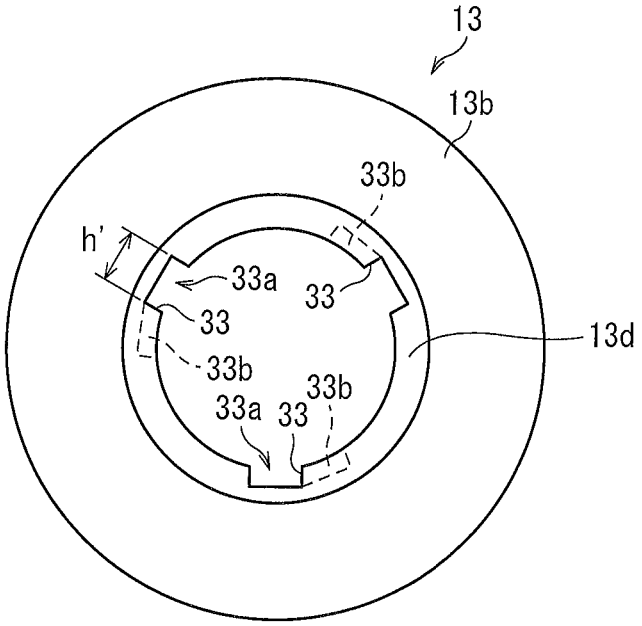
Figure 7:
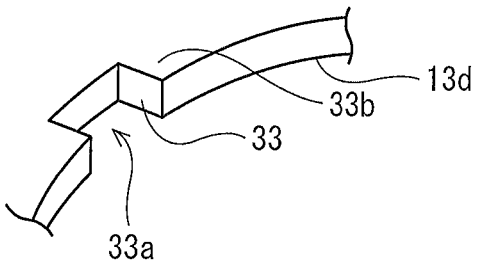
Figure 8:
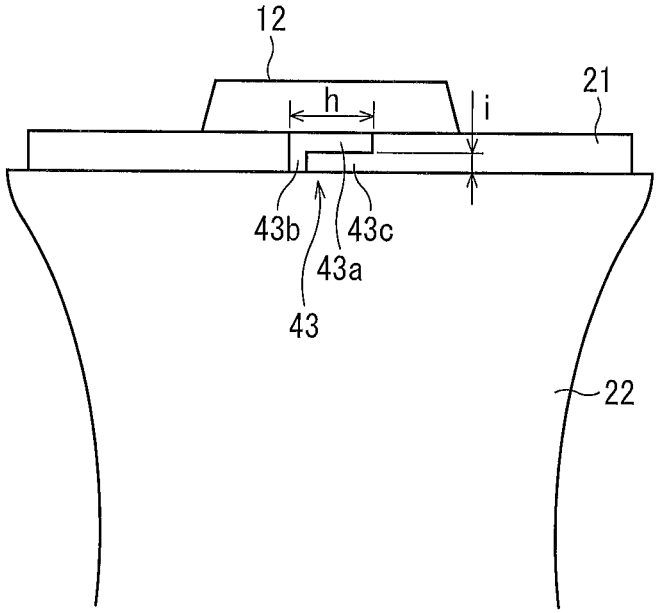
FIG. 8 (*a*) is a side view illustrating a radiator plate and a radiator member provided in the illumination device of the still another embodiment of the present invention.
Figure 8:
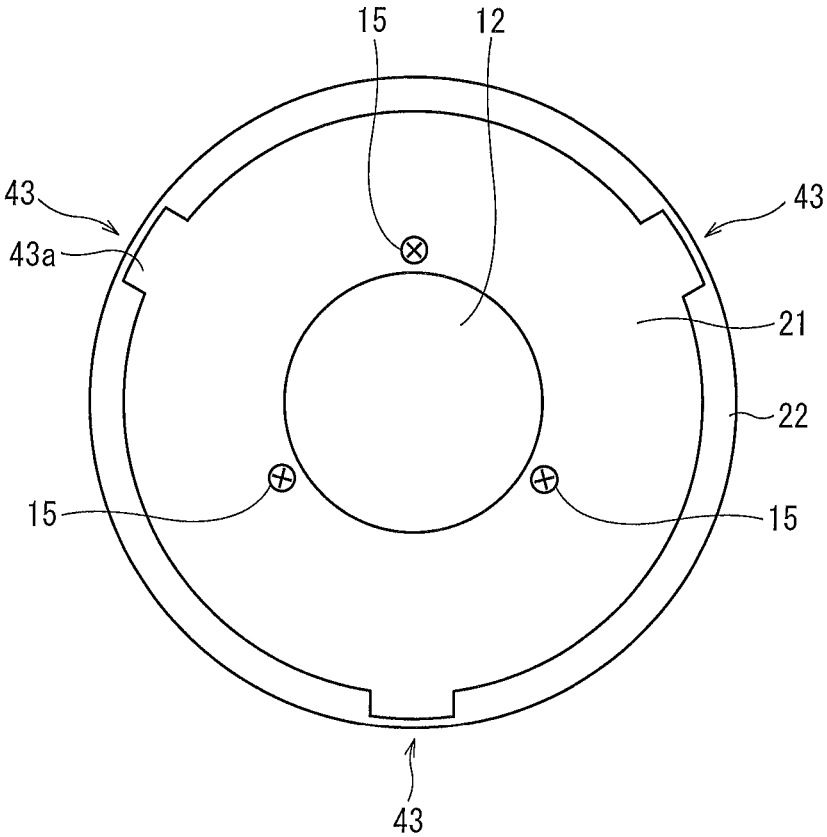

FIG. 7 (*a*) is a perspective view illustrating a globe cover 13 of the present embodiment, and FIG. 7 (*b*) is a plan view illustrating a bottom surface side of the globe cover 13. FIG. 8 (*a*) and FIG. 8 (*b*) are a side view and a top view illustrating a radiator plate 21 with which the globe cover 13 illustrated in FIG. 7 (*a*) and FIG. 7 (*b*) is to be engaged, respectively.

As illustrated in FIG. 7 (*b*), an opening edge section 13*d* of the globe cover 13 is provided with a plurality of cutout sections (engaged section) 33 along a circumferential direction. FIG. 7 (*c*) is a perspective view illustrating a configuration of the globe cover 13 around the cutout section 33. As illustrated in FIG. 7 (*c*), each of the cutout sections 33 has such a shape that a part of the opening edge section 13*d* of the globe cover 13 is cut out in a rectangular shape. Note that the cutout sections 33 may be evenly spaced apart from each other or may be unevenly spaced apart from each other.

As illustrated in FIG. 8 (*a*) and FIG. 8 (*b*), the periphery of the radiator plate 21 is provided, at positions corresponding to the respective cutout sections 33 of the globe cover 13, with projections (engaging section) 43 that protrude from the periphery of the radiator plate 21 outwardly in a radial direction. Each of the projections 43 has (i) a first part (axial direction movement restricting section) 43*a* whose top surface is flush with a top surface of the radiator plate 21 and whose thickness is smaller than that of the radiator plate 21 and (ii) a second part (rotation restricting section) 43*b* whose top surface is flush with the top surface of the radiator plate 21 and whose thickness is substantially identical to that of the radiator plate 21. The first part 43*a* and the second part 43*b* are continuously provided in this order in a clockwise direction when viewed from the top surface side of the radiator plate 21.

A width h of the projection 43 along the circumferential direction of the radiator plate 21 is identical to or smaller than a width h' of the cutout section 33 of the globe cover 13 along the circumferential direction of the opening edge section 13*d*. A distance i between the first part 43*a* and the top surface of the periphery of the radiator member 22, i.e., a difference between the thickness of the radiator plate 21 and the thickness of the first part 43*a* is identical to or larger than the thickness of the opening edge section 13*d* of the globe cover 13 in the axial direction of the radiator member 22.

With the arrangement, by rotating the globe cover 13 in an attachment direction (in the present embodiment, a counterclockwise direction when viewed from the top surface side of the radiator plate 21) along an in-plane direction of the radiator plate 21 after inserting the projections 43 of the radiator plate 21 into respective spaces (inserted sections) 33*a* that are cut out from the opening edge section 13*d* of the globe cover 13 by the cutout sections 33 corresponding to the respective projections 43 so that the projections 43 are stored in the globe cover 13, the projections 43 are stored in and engaged with respective regions (storing section) 33*b* (see the broken line of FIG. 7 (*b*)) that are on an inner surface side of the opening edge section 13*d* of the globe cover 13 and that are adjacent to the corresponding cutout sections 33 in a counterclockwise direction when viewed from the top surface side of the radiator plate 21. That is, parts of the opening edge section 13*d* of the globe cover 13 that are adjacent to the respective cutout sections 33 in a counterclockwise direction when viewed from the top surface side of the radiator plate 21 are stored in respective spaces 43*c* formed between the first parts 43*a* of the projections 43 and the radiator member 22, and the first parts (axial direction movement restricting section) 43*a* restrict movement of the globe cover 13 in the axial direction of the radiator member 22. Furthermore, rotation of the globe cover 13 in the attachment direction beyond a predetermined engagement position by more than a predetermined angle is restricted because the parts of the opening edge section 13*d* of the globe cover 13 that are adjacent to the respective cutout sections 33 in the counterclockwise direction when viewed from the top surface side of the radiator plate 21 make contact with the respective second parts (rotation restricting section) 43*b* of the projections 43 of the radiator plate 21. As in Embodiments 1 through 3, the globe cover 13 is bonded to the radiator plate 21 in the engagement state with the use of an adhesive.

In the present embodiment, the radiator plate 21 and the radiator member 22 are produced as separate members by respective separate molding steps, and then the radiator plate 21 is attached to the radiator member 22. This makes it possible to form the projections 43 of the radiator plate 21 in the molding step for producing the radiator plate 21.

More specifically, in order to restrict movement of the opening edge section 13*d* of the globe cover 13 in the axial direction of the radiator member 22, each of the projections 43 is configured to have the first part 43*a* which is closed on the top surface side of the radiator plate 21 and is opened on the bottom surface side of the radiator plate 21 so that the space 43*c* is formed between the first part 43*a* and the radiator member 22. Accordingly, in a case where the radiator plate 21 and the radiator member 22 are integrally formed by a single molding step, a mold used for the molding step cannot be pulled out in the axial direction of the radiator member 22 because parts of the mold that correspond to the spaces 43*c* are stopped by the first parts 43*a* of the radiator plate 21. It is therefore conventionally difficult to form the projections 43 configured as above by a molding step. Accordingly, in a case where the radiator plate 21 and the radiator member 22 are integrally formed by a single molding step, it is necessary to form a disc member having an external diameter corresponding to an external diameter of the first part 43*a* and the radiator member 22 by a molding step and then form the radiator plate 21 and the projections 43 by a cutting process (machining process) of the disc member. This means an increase in the number of production steps, which invites an increase in production cost.

Note that in a case where the radiator plate 21 and the radiator member 22 are integrally formed by a single molding step, it is also thinkable to pull out the mold used for the molding step in a direction perpendicular to the axial direction of the radiator member 22. This is, however, difficult to achieve because the mold needs to be divided into pieces whose number corresponds to the number of projections 43 (in the present embodiment, three) in order to prevent the mold from interfering with the projections 43.

On the other hand, in the present embodiment, the radiator plate 21 and the radiator member 22 are produced by respective separate molding steps, and then the radiator plate 21 is attached to the radiator member 22. Accordingly, in the molding step for forming the radiator plate 21, a mold used for the molding step can be pulled out in a direction (corresponding to the axial direction of the radiator member 22) perpendicular to the in-plane direction of the radiator plate 21 without being stopped by the first parts 43*a*. It is therefore possible to form the entire radiator plate 21, including the projections 43, by a single molding step. This makes it possible to easily produce the radiator plate 21, including the projections 43, at low cost.

As described above, the illumination device 10 of each of the embodiments above is arranged such that (i) one of the periphery of the radiator plate 21 and the opening edge section 13*d* of the globe cover 13 is provided with a plurality of engaging sections (projections 31, 32, or 43) and (ii) and the other one is provided, at positions corresponding to the respective engaging sections, with engaged sections (the cutout sections 41, the grooves 42, the cutout sections 52, or the cutout sections 33) which are to be engaged with the respective engaging sections so as to restrict movement of the globe cover 13 in the axial direction of the radiator member 22. The globe cover 13 and the radiator plate 21 are bonded to each other with the use of an adhesive in a state in which the engaged sections and the engaging sections are engaged with each other.

By thus engaging the engaged sections with the respective engaging sections, it is possible to restrict movement of the globe cover 13 in the axial direction of the radiator member 22. It is therefore possible to prevent the globe cover 13 from falling even in a case where adhesive power of the adhesive has decreased.

In each of the embodiments above, the globe cover 13 and the radiator plate 21 are bonded to each other with the use of an adhesive. However, each of the embodiments above is not limited to this. It is only necessary that the globe cover 13 and at least one of the radiator plate 21 and the radiator member 22 be bonded to each other. That is, it is only necessary that at least one of (i) opposing parts of the globe cover 13 and the radiator plate 21 and (ii) opposing parts of the globe cover 13 and the radiator member 22 be at least partially bonded to each other with the use of an adhesive. Note that in order to prevent intrusion of moisture etc. into the globe cover 13, it is preferable that entire areas, in a circumferential direction, of at least one of (i) the opposing parts of the globe cover 13 and the radiator plate 21 and (ii) the opposing parts of the globe cover 13 and the radiator member 22 be bonded to each other with the use of an adhesive.

Each of the embodiments above has discussed an arrangement in which three engaging sections (the projections 31, 32, 34 or 43) and three engaged sections (the cutout sections 41, the grooves 42, the cutout sections 52 or the cutout sections 33) are provided. However, the number of engaging sections and the number of engaged sections are not limited to this, provided that movement of the globe cover 13 in the axial direction of the radiator member 22 can be restricted through engagement between the engaging sections and the engaged sections. Furthermore, a shape of each of the engaging sections and a shape of each of the engaged sections are not limited to those described above, provided that movement of the globe cover 13 in the axial direction of the radiator member 22 can be restricted through engagement between the engaging sections and the engaged sections.

Each of the embodiments above has discussed an arrangement in which the globe cover 13 and the radiator plate (top plate section) 21 are engaged with each other, but is not limited to this. It is also possible to (i) provide, separately from the radiator plate 21, a member (top plate section) disposed so as to cover an opening of the radiator member 22 and (ii) cause the member to be engaged with the globe cover 13. For example, it is also possible to (i) provide, on the radiator plate 21, a reflecting plate (top plate section) reflecting light emitted from a light source and (ii) cause the reflecting plate to be engaged with the globe cover 13. Alternatively, it is also possible to (i) design an LED substrate 12 to have a shape corresponding to an inner periphery of the opening edge section 13*d* of the globe cover 13 and (ii) cause the LED substrate (top plate section) 12 to be engaged with the globe cover 13.

Each of the embodiments above has discussed the illumination device 10 including, as light sources, the LEDs 11. Note, however, that the light sources are not limited to the LEDs 11, and can be other light sources such as fluorescent substances, electroluminescence (EL) elements, and semiconductor light sources. Moreover, a color of light emitted from the light sources is not limited in particular, and can be any color.

Each of the embodiments above has discussed the illumination device 10 in which the globe cover 13 is substantially spherical in shape (ball shape). Note, however, that the shape of the globe cover 13 is not limited to this, and can be, for example, a shape (A-shape) similar to a general incandescent light bulb, a ref-type shape (R-shape), or a cylindrical shape (T-shape).

In each of the embodiments above, a globe cover is formed by bonding the upper part (separate member) 13*a* and the lower part (separate member) 13*b* that are formed by respective separate molding steps. Note, however, that a joint plane where separate members which will form the globe cover are bonded is not limited to this. For example, the globe cover 13 may be formed by bonding two members formed by respective separate molding steps on a joint plane along the axial direction of the radiator member 22. Alternatively, the globe cover 13 may be formed by bonding three or more members formed by respective separate steps. Moreover, the globe cover 13 need not necessarily be formed by bonding a plurality of members, and the entire globe cover 13 may be formed by a single molding step.

Each of the embodiments above has discussed the illumination device 10 (so-called light-bulb-shaped illumination device) including the base 4 threadably attached to a socket of an installation portion, but is not limited to this. The illumination device 10 is not limited to a specific one, provided that it is an illumination device arranged such that a cover member is attached to a housing section, and can be, for example, a ceiling light, a wall light, or a street light.

Each of the embodiments above has discussed an arrangement in which the radiator member (housing section) 22 has a cylindrical shape whose opening area becomes smaller towards the base 4 side. Note, however, that the shape of the radiator member 22 is not limited to this. For example, the radiator member 22 may have a straight cylindrical shape, or may have a tapered cylindrical shape, or may have a shape combining these shapes.

Each of the embodiments above has discussed an arrangement in which rotation of the globe cover 13 by more than a predetermined angle in a counterclockwise direction when viewed from the top surface side of the radiator plate 21 is restricted in a state in which the engaging sections (the projections 31, 32, 34 or 43) are engaged with the respective engaged sections (the cutout sections 41, the grooves 42, the cutout sections 52 or the cutout sections 33). Note, however, that each of the embodiments above is not limited to this. For example, such an arrangement is also possible in which rotation of the globe cover 13 by more than a predetermined angle in a clockwise direction when viewed from the top surface side of the radiator plate 21 is restricted in the engagement state. Alternatively, such an arrangement is also possible in which rotation of the globe cover 13 is not restricted in the engagement state.

According to the arrangement in which rotation of the globe cover 13 with respect to the radiator plate 21 in a direction of rotation of the illumination device 10 that is being removed from the socket is restricted, it is possible to prevent only the globe cover 13 from being detached as a result of disengagement of the globe cover 13 from the radiator plate 21 in removal of the illumination device 10 from the socket, even in a case where adhesive power of the adhesive has decreased. Meanwhile, according to the arrangement in which rotation of the globe cover 13 with respect to the radiator plate 21 in a direction of rotation of the illumination device 10 that is being attached to the socket is restricted, it is possible to prevent the globe cover 13 from being detached as a result of disengagement of the globe cover 13 from the radiator plate 21 because of excessive rotation of the illumination device 10 that is being attached to the socket.

The present embodiment has discussed an arrangement in which one of the globe cover 13 and the radiator plate 21 is provided with a plurality of engaging sections (projections 31, 32, 34 or 43) and the other one is provided with a plurality of engaged sections (the cutout sections 41, the grooves 42, the cutout sections 52, or the cutout sections 33). Note, however, that the present embodiment is not limited to this. For example, such an arrangement is also possible in which (i) the opening edge section 13*d* of the globe cover 13 is provided with engaged sections and engaging sections and (ii) the periphery of the radiator plate 21 is provided, at positions corresponding to the engaged sections and the engaging sections, engaging sections and engaged sections to be engaged with the respective engaged sections and the respective engaging sections of the opening edge section 13*d*.

As described above, an illumination device of the present invention includes: a housing section having a cylindrical shape; a top plate section attached to one end of the housing section, the top plate section being formed separately from the housing section; a light source section provided on the top plate section; and a cover member disposed so as to cover the light source section and the top plate section, the cover member having light transmittance, at least one of the top plate section and the cover member having at least one engaging section which is provided in a part facing the other one, and the other one having at least one engaged section which is provided in a position corresponding to the at least one engaging section, and the cover member being attached to the top plate section by causing the at least one engaging section and the at least one engaged section to be engaged with each other so that movement of the cover member in an axial direction of the housing section is restricted.

According to the arrangement, the cover member is attached to the top plate section in such a manner that the engaging section and the engaged section are engaged with each other so that movement of the cover member in the axial direction of the cylindrical housing section is restricted. This makes it possible to stably prevent, for a long term, the cover member which encloses a light source so as to cover the light source from being detached.

The illumination device may be arranged such that the top plate section is formed by a molding process; and the least one engaging section or the at least one engaged section of the top plate section being formed by the molding process for forming the top plate section.

According to the arrangement, the engaging section or the engaged section provided on the top plate section is formed by a molding process for forming the top plate section. This makes it unnecessary to perform a machining process for forming the engaging section or the engaged section, thereby allowing a reduction in manufacturing cost.

The illumination device may be arranged such that the at least one engaged section has (i) an inserted section which is opened in the axial direction of the housing section and into which the at least one engaging section is to be inserted and (ii) a storing section which extends from a part of the inserted section in a direction perpendicular to the axial direction so as to be continuous with the part of the inserted section and in which the at least one engaging section is to be stored.

According to the arrangement, by causing the engaged section to be stored in the storing section, it is possible to easily engage the engaging section and the engaged section so that movement of the cover member in the axial direction is restricted.

The illumination device may be arranged such that the at least one engaging section is provided on the cover member; the cover member is a hollow three-dimensional member having a circular opening edge section on a side facing the housing section; and the at least one engaging section has a shape protruding from the opening edge section of the cover member inwardly in a radial direction of a circle formed by the opening edge section. Alternatively, the illumination device is arranged such that the at least one engaging section is provided on the cover member; the cover member is a hollow three-dimensional member having a circular opening edge section on a side facing the housing section; and the at least one engaging section has a shape protruding from the opening edge section of the cover member outwardly in a radial direction of a circle formed by the opening edge section.

According to the arrangements, it is possible to easily engage the engaged section provided on the opening edge section of the cover member and the engaging section provided on the top plate section at a position corresponding to the engaged section. Moreover, since the engaged section is provided on the top plate section which is formed separately from the housing section, it is unnecessary to perform a machining process for forming a cover attachment groove after a molding process, unlike the arrangement of Patent Literature 1 in which a light source attachment section (top plate section) and a peripheral wall (housing section) are integrally molded. This allows a reduction in manufacturing cost.

The illumination device may be arranged such that the cover member is formed by bonding a plurality of separate members which are separately formed by respective molding processes; and the at least one engaged section or the at least one engaging section of the cover member is formed on one or more of the plurality of separate members by corresponding one or more of the molding processes.

According to the arrangement, even in a case where the opening edge section of the cover member is provided with the engaged section or the engaging section, it is possible to easily form the cover member including the engaged section or the engaging section by a molding process. Especially in a case where the opening edge section of the cover member is provided with an engaging section which protrudes from the opening edge section inwardly in a radial direction of a circle formed by the opening edge section, integrally molding the entire cover member as in a conventional general production method results in a situation in which a mold disposed inside a hollow part is stopped by the engaging section. It is therefore difficult to provide the engaging section. On the other hand, according to the above arrangement, the cover member is formed by bonding a first cover member and a second cover member that are separately formed by respective molding processes, it is possible to easily form even an engaging section which protrudes inwardly in a radial direction of a circle formed by the opening edge section.

The illumination device may be arranged such that at least one of the cover member and the top plate section has a rotation restricting section which restricts rotation of the cover member with respect to the top plate section in a circumferential direction by more than a predetermined angle beyond an engagement position of the at least one engaging section and the at least one engaged section.

According to the arrangement, it is possible to restrict rotation of the cover member by more than a predetermined angle beyond the engagement position. It is therefore possible to stably engage the cover member and the top plate section with each other.

The illumination device may be arranged to further include a base having a spiral screw thread via which the illumination device is to be attached to a socket, the rotation restricting section being provided so as to restrict rotation of the cover member with respect to the top plate section in a direction of rotation of the illumination device that is being removed from the socket.

According to the arrangement, even in a case where adhesive power of an adhesive has decreased, it is possible to prevent only the cover member from being detached as a result of disengagement of the cover member from the top plate section in removal of the illumination device from the socket.

The illumination device according to claim 8 may be arranged to further include a base having a spiral screw thread via which the illumination device is to be attached to a socket, the rotation restricting section being provided so as to restrict rotation of the cover member with respect to the top plate section in a direction of rotation of the illumination device that is being attached to the socket.

According to the arrangement, it is possible to prevent the cover member from being detached as a result of disengagement of the cover member from the top plate section because of excessive rotation of the illumination device that is being attached to the socket.

The present invention is not limited to the description of the embodiments above, but may be altered by a skilled person within the scope of the claims. An embodiment based on a proper combination of technical means disclosed in different embodiments is encompassed in the technical scope of the present invention.

INDUSTRIAL APPLICABILITY

The present invention is applicable to an illumination device including a light-transmitting cover member which encloses a light source so as to cover the light source.

REFERENCE SIGNS LIST

1: Light-emitting section
2: Support section
3: Insulating ring
4: Base
10: Illumination device
11: LED (light source section)
12: LED substrate (light source section)
13: Globe cover (cover member)
13*a*: Upper part (separate member)
13*b*: Lower part (separate member)
13*c*: Joint plane
13*d*: Opening edge section
21: Radiator plate (top plate section)
22: Radiator member (housing section)
31: Projection (engaging section)
32: Projection (engaging section)
33: Cutout section (engaged section, inserted section)
34: Projections (engaging section)
41: Cutout section (engaged section)
41*a*: First cutout section (inserted section)
41*b*: Second cutout section (storing section)
41*c*: Blocking section (rotation restricting section)
41*d*: Protecting section (axial direction movement restricting section)
42: Groove (engaged section)
42*a*: First part (rotation restricting section)
42*b*: Second part (axial direction movement restricting section)
42*c*: Groove formation part
42*d*: First groove
42*e*: Second groove (storing section)
43: Projection (engaging section)
43*a*: First part (axial direction movement restricting section)
43*b*: Second part (rotation restricting section)
52: Cutout section (engaged section)
52*a*: First cutout section (inserted section)
52*b*: Second cutout section (storing section)
52*c*: Third cutout section (storing section)
52*d*: Protecting section (axial direction movement restricting section)
52*e*: Blocking section (rotation restricting section)

The invention claimed is:

1. An illumination device comprising:

a housing section having a cylindrical shape;

a top plate that is a flat disc-shaped member attached to one end of the housing section that covers an opening in the housing section, the top plate defined separately from the housing section and including a cutout on a peripheral portion of the top plate that penetrates through the top plate in a top-to-bottom direction, and a protecting section adjacent to the cutout on the peripheral portion that is thinner than the top plate;

a light source section on the top plate;

a cover member that covers the light source section and the top plate, the cover member having light transmittance and including at least one engaging section that engages with the top plate by being retained in a storing section that is between the protecting section and the one end of the housing section and that is continuous with the cutout;

a rotation restricting section that restricts rotation of the cover member with respect to the top plate in a circumferential direction by more than a predetermined angle at an end of the storing section of the top plate;

a base including a spiral screw thread via which the illumination device is attached to a socket, the rotation restricting section being provided to restrict rotation of the cover member with respect to the top plate in a direction of rotation of the illumination device that is being removed from the socket, wherein the cover member is attached to the top plate so that movement of the cover member in an axial direction of the housing section is restricted by the at least one engaging section and the protecting section.

2. The illumination device according to claim 1, wherein:

the at least one engaging section is provided on the cover member;

the cover member is a hollow three-dimensional member having a circular opening edge section on a side facing the housing section; and the at least one engaging section has a shape protruding from the opening edge section of the cover member inwardly in a radial direction of a circle formed by the opening edge section.

3. The illumination device according to claim 1, wherein:

the at least one engaging section is provided on the cover member;

the cover member is a hollow three-dimensional member having a circular opening edge section on a side facing the housing section; and the at least one engaging section has a shape protruding from the opening edge section of the cover member outwardly in a radial direction of a circle formed by the opening edge section.

4. The illumination device according to claim 1, wherein:

the cover member is formed by bonding a plurality of separate members which are separately formed by respective molding processes; and the at least one engaged section or the at least one engaging section of the cover member is formed on one or more of the plurality of separate members by corresponding one or more of the molding processes.

* * * * *